US010597952B2

(12) United States Patent
Otten et al.

(10) Patent No.: US 10,597,952 B2
(45) Date of Patent: Mar. 24, 2020

(54) STEEL CATENARY RISER TOP INTERFACE

(71) Applicant: Single Buoy Moorings, Inc., Marly (CH)

(72) Inventors: Jeffrey Douglas Otten, Cypress, TX (US); Peimin Cao, Sugar Land, TX (US); Thomas Prichard, Houston, TX (US)

(73) Assignee: SINGLE BUOY MOORINGS, INC., Marly (CH)

( * ) Notice: Subject to any disclaimer, the term of this patent is extended or adjusted under 35 U.S.C. 154(b) by 0 days.

(21) Appl. No.: 15/917,172

(22) Filed: Mar. 9, 2018

(65) Prior Publication Data

US 2018/0258711 A1 Sep. 13, 2018

Related U.S. Application Data

(60) Provisional application No. 62/469,161, filed on Mar. 9, 2017, provisional application No. 62/473,053, filed on Mar. 17, 2017.

(51) Int. Cl.

| | |
|---|---|
| ***E21B 19/00*** | (2006.01) |
| ***E21B 43/01*** | (2006.01) |
| ***E21B 17/01*** | (2006.01) |

(52) U.S. Cl.

CPC ..... *E21B 19/006* (2013.01); *E21B 17/01* (2013.01); *E21B 17/015* (2013.01); *E21B 19/004* (2013.01); *E21B 43/0107* (2013.01)

(58) Field of Classification Search

CPC ..... E21B 17/01; E21B 17/015; E21B 19/004; E21B 19/006; E21B 43/0107; E21B 43/013

USPC ..... 114/293

See application file for complete search history.

(56) References Cited

U.S. PATENT DOCUMENTS

| | | | | |
|---|---|---|---|---|
| 5,447,392 | A * | 9/1995 | Marshall | E21B 19/006 405/224.4 |
| 5,517,937 | A * | 5/1996 | Lunde | B63B 21/507 114/230.12 |
| 2002/0009336 | A1 | 1/2002 | Munk et al. | |
| 2003/0000447 | A1 | 1/2003 | Fontenot et al. | |
| 2003/0121465 | A1 | 7/2003 | Boatman et al. | |
| 2005/0224227 | A1 * | 10/2005 | Hendrie | E21B 17/1014 166/241.6 |
| 2006/0070741 | A1 | 4/2006 | Pollack et al. | |
| 2007/0056741 | A1 | 3/2007 | Finn et al. | |
| 2008/0214072 | A1 | 9/2008 | Saint-Marcoux | |

(Continued)

FOREIGN PATENT DOCUMENTS

| | | | |
|---|---|---|---|
| CN | 103935477 | A | 7/2014 |
| WO | 9307048 | A1 | 4/1993 |

(Continued)

OTHER PUBLICATIONS

Invitation to Pay Additional Fees received in PCT Application No. PCT/IB2018/051569, mailed Jun. 7, 2018.

*Primary Examiner* — James G Sayre
(74) *Attorney, Agent, or Firm* — Young & Thompson

(57) ABSTRACT

A top interface for subsea riser on offshore, floating vessel has an upper funnel and a co-axial lower funnel in spaced-apart relation. Tension loads on the riser are reacted at the upper funnel while lateral and bending loads are reacted at the lower funnel. The riser top interface may be used with flexible risers or steel catenary risers.

17 Claims, 15 Drawing Sheets

(56) References Cited

U.S. PATENT DOCUMENTS

| | | | |
|---|---|---|---|
| 2009/0078425 | A1 | 3/2009 | Wajnikonis et al. |
| 2011/0226484 | A1 | 9/2011 | Lavagna |
| 2012/0145407 | A1 | 6/2012 | Varley et al. |
| 2013/0299179 | A1 | 11/2013 | Joensen et al. |
| 2014/0328631 | A1 | 11/2014 | Luo et al. |

FOREIGN PATENT DOCUMENTS

| | | | | |
|---|---|---|---|---|
| WO | WO-9307048 | A1 * | 4/1993 | ..... E21B 19/002 |
| WO | 0063598 | A1 | 10/2000 | |
| WO | 2008152289 | A2 | 12/2008 | |
| WO | 2015091624 | A1 | 6/2015 | |
| WO | 2016028792 | A1 | 2/2016 | |

* cited by examiner

FULLY LOADED DRAFT
BALLAST DRAFT
10
40
50

DETAIL

DETAIL

STEEL CATENARY RISER TOP INTERFACE

CROSS-REFERENCE TO RELATED APPLICATIONS

This application claims the benefit of U.S. Provisional Patent Application No. 62/469,161 filed on Mar. 9, 2017, and U.S. Provisional Patent Application No. 62/473,053 filed on Mar. 17, 2017, the contents of which are hereby incorporated by reference in their entireties.

FEDERALLY SPONSORED RESEARCH OR DEVELOPMENT

Not Applicable

BACKGROUND OF THE INVENTION

1. Field of the Invention

The present invention generally relates to offshore oil and gas production. More specifically, it relates to the connection of subsea risers to floating vessels, particularly Floating Production, Storage and Offloading (FPSO) vessels.

2. Description of the Related Art Including Information Disclosed Under 37 CFR 1.97 and 1.98

A Floating Production, Storage and Offloading (FPSO) unit is a floating vessel used by the offshore oil and gas industry for the production and processing of hydrocarbons, and for the storage of oil. A FPSO vessel may be designed to receive hydrocarbons produced by itself or from nearby platforms or subsea template, process them, and store oil until it can be offloaded onto a tanker or, less frequently, transported through a pipeline. FPSOs are preferred in frontier offshore regions as they are easy to install, and do not require a local pipeline infrastructure to export oil. FPSOs may be a conversion of an oil tanker or may be a vessel built specially for the application. A vessel used only to store oil (without processing it) is referred to as a Floating Storage and Offloading vessel (FSO).

Oil produced from offshore production platforms may be transported to the mainland either by pipeline or by tanker. When a tanker is chosen to transport the oil, it is necessary to accumulate oil in some form of storage tank, such that the oil tanker is not continuously occupied during oil production, and is only needed once sufficient oil has been produced to fill the tanker.

Floating production, storage and offloading vessels are particularly effective in remote or deep water locations, where seabed pipelines are not cost-effective. FPSOs eliminate the need to lay expensive long-distance pipelines from the processing facility to an onshore terminal. This may provide an economically attractive solution for smaller oil fields, which may be exhausted in a few years and do not justify the expense of installing a pipeline. Furthermore, once the field is depleted, the FPSO may be moved to a new location.

FPSO vessels may include a turret mooring system wherein subsea risers are in fluid communication with processing equipment on the FPSO vessel via a swivel stack and the vessel may weathervane about the turret. Alternatively, if metocean conditions permit, an FPSO vessel may be spread-moored. Subsea risers may be terminated along the port or starboard bow, port or starboard beam, port or starboard quarter, or stern of a spread-moored FPSO vessel.

A steel catenary riser (SCR) is a common method of connecting a subsea pipeline to a deepwater floating or fixed oil production platform. SCRs are used to transfer fluids like oil, gas, injection water, etc. between the platforms and the pipelines.

A steel catenary riser (SCR) is a steel pipe hung in a catenary configuration from a floating vessel in deep water to transmit flow to or from the sea floor.

In the offshore industry the word catenary may be used as an adjective or noun with a meaning wider than is its historical meaning in mathematics. Thus, an SCR that uses a rigid, steel pipe that has a considerable bending stiffness may be described as a catenary. That is because, in the scale of depth of the ocean, the bending stiffness of a rigid pipe has little effect on the shape of the suspended span of an SCR. The shape assumed by the SCR is controlled mainly by weight, buoyancy and hydrodynamic forces due to currents and waves. Thus, in spite of using conventional, rigid steel pipe, the shape of an SCR may be closely approximated with the use of ideal catenary equations, used historically to describe the shape of a chain suspended between points in space. A chain line has by definition a zero bending stiffness and those described with the ideal catenary equations use infinitesimally short links.

The rigid pipe of the SCR forms a catenary between its hang-off point on the floating or rigid platform, and the seabed. A free-hanging SCR assumes a shape roughly similar to the letter 'J'. A catenary of a lazy wave SCR consists of at least three catenary segments. The top- and the seabed-segments of the catenary have negative submerged weight, and their curvatures 'bulge' towards the seabed. The middle segment has buoyant material attached along its entire length, so that the ensemble of the steel pipe and the buoyancy is positively buoyant. Accordingly, the curvature of the buoyant segment 'bulges' upwards (inverted catenary), and its shape may also be well-approximated with the same ideal catenary equations. The positively and negatively buoyant segments are tangent to each other at the points where they join. The overall catenary shape of the SCR has, at those locations, points of inflection. Lazy wave SCRs were first installed on a turret moored FPSO offshore Brazil in 2009 (although lazy wave configuration flexible risers were in wide use for several decades beforehand).

The SCR pipe and a short segment of pipe lying on the seabed use "dynamic pipe,"—steel pipe having slightly greater wall thickness than the nominal pipeline wall thickness, in order to sustain dynamic bending and material fatigue encountered in the touch-down zone of the SCR. Beyond that the SCR is typically extended with a rigid pipeline, but the use of a flexible pipeline is also feasible. The risers are typically 8-12 inches in diameter and operate at a pressure of 2000-10,000 psi. Designs beyond those ranges of pipe sizes and operating pressures are also feasible.

BRIEF SUMMARY OF THE INVENTION

A riser top interface for a floating, offshore vessel (e.g. a spread-moored FPSO) has an upper funnel and a co-axial, lower funnel spaced apart from the upper funnel. Tension loads on the riser are reacted at the upper funnel while lateral and bending loads are reacted at the lower funnel. A riser top interface according to the invention may be used with flexible risers or steel catenary risers. The steel catenary risers may be equipped with a flex joint or a tapered stress joint proximate the lower funnel.

BRIEF DESCRIPTION OF THE SEVERAL VIEWS OF THE DRAWING(S)

DETAILED DESCRIPTION OF THE INVENTION

Figure 1A:
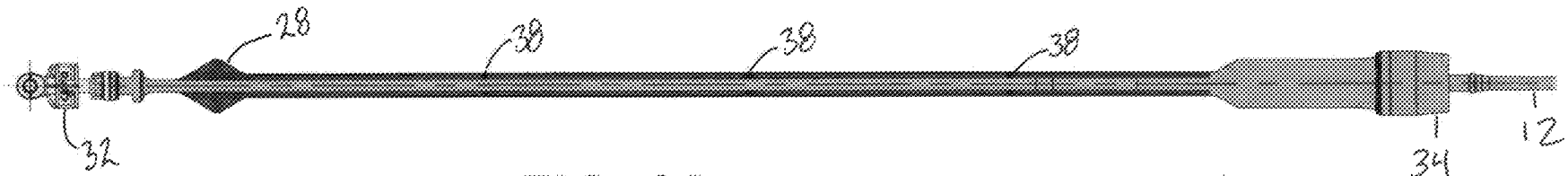
FIG. 1A is a cross-sectional view of a pipe-in-pipe upper SCR tension segment according to an embodiment

The invention may best be understood by reference to the exemplary embodiments illustrated in the drawing figures wherein the following reference numbers are used to indicate the associated elements:

10 vessel hull
12 SCR
14 flexible riser
16 split flange
17 upper funnel
18 lower funnel
20 lateral and bending load interface
22 bend stiffener locking latch
24 pull head release latch
26 tri-plate
28 upper centralizer
29 lower centralizer
30 bumpers
32 pull head
34 flex joint
36 flange
38 spacer
40 pipe-in-pipe section (outer pipe)
42 tension load-bearing flange
44 annulus
46 vent and pressure test fitting
48 section flange
50 riser tension section
54 winch
56 FPSO vessel
58 pipe lay vessel
60 attachment flange
62 centralization dogs
64 barrier welded connection
66 upper porch
68 lower porch
70 bend stiffener [bend restrictor]
72 flexible riser pull head
73 riser hang-off shoulder
74 tapered stress joint
75 riser bore The present invention was developed to simplify the connection of a steel catenary riser (SCR) to a floating, offshore vessel (such as a spread-moored FPSO, tension leg platform, semi-submersible, spar-type vessel or the like) having a hull (10). The invention employs two separate funnels (17 and 18), one below water (18) and one above water (17). The lower funnel (18) reacts the lateral and bending loads and the upper funnel (17) reacts the tension loads. The upper funnel (17) allows personnel access for connection of the tension support and for valve and piping connections to be made without requiring divers. The SCR (12) requires a special top joint that spans between the two coaxial, spaced-apart funnels (17 and 18).

Two SCR versions are illustrated as exemplars: a pipe-in-pipe version (see FIGS. 1A and 1B); and, a single pipe version (see FIGS. 2A and 2B) with a series of spaced-apart bumpers (30). The pipe-in-pipe version provides improved thermal profile and potentially greater mechanical protection to the riser should an impact occur.

The upper support may be a split flange (16) that fits a profile (42) on the top joint and bolts to the upper guide funnel (17). The lower support may have radial dog segments (62) for diver or ROV actuation to support lateral and bending loads.

Elastomeric flex joints (34) may be used for FPSO applications, but tapered stress joints (74), either titanium or steel, may also be adapted for use with the two funnel configuration of the invention.

In an embodiment, a flexible riser (14) is fitted in the lower guide funnel (18). This may be accomplished by flanging a flexible riser pull-in support (20') in place of the SCR clamp configuration. Thus, the capability to convert from SCR to flexible hang-off may be provided on the same location.

SCR pull-in has been done on FPSOs with traditional hang-off baskets and with specialized hang-off assemblies. Turret and disconnectable systems of the prior art use a pull-in tube with a hang-off clamp to support lateral and bending loads. The arrangement of the present invention uses a similar style hang-off clamp at the lower funnel and similar hang-flange at the upper funnel, to the turret arrangement pull-in tube.

SCR lazy wave risers may be an effective solution in deep water applications. However, with the hang-off porch below the water surface, the connection and pull-in operation are heavily dependent on diver intervention. Diver intervention increases the time and cost of the operation.

The present invention reduces the scope of diver work required and moves many of the connection steps above the water, allowing workers better access. The piping spool is also difficult to install using the apparatus and methods of the prior art due to size, handling access, and diver connections required.

Some SCR basket-type systems place the flex bearing above water level for connection and partially during use. This has been shown to reduce the elastomer life by raising the temperature of the elastomer. Also, repeated travel into and out of the water may increase corrosion in equipment. By keeping the lower funnel below the water surface, the benefit of seawater cooling may be maintained and corrosion protection of the cathodic protection system may be maintained.

Figure 1C:
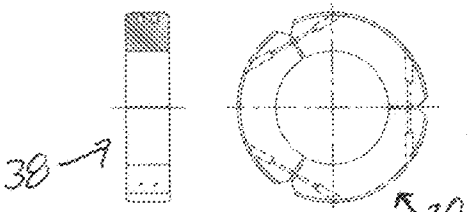
FIG. 1C shows top, side, and cross-sectional views of the HPDE spacer used in the pipe-in-pipe upper SCR tension segment shown in FIGS. 1A and 1B.
Figure 1B:
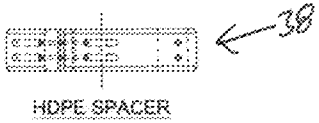
FIG. 1B is an enlarged, cross-sectional view of the pipe-in-pipe upper SCR tension segment shown in FIG. 1A.
Figure 1B:
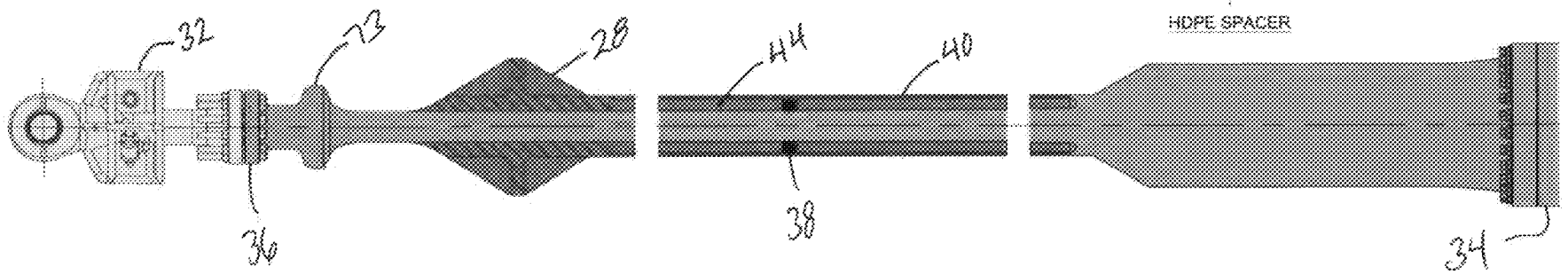

Referring now to FIGS. 1A, 1B, and 1C, steel catenary riser (SCR) 12 comprises a novel upper section (50 in FIG. 1D) between flex joint 34 and upper flange 36 to which pull head 32 is attached. The central, fluid-carrying portion of SCR 12 is surrounded in this section by outer pipe 40 held in spaced apart relation by a plurality of spacers 38 to form a pipe-in-pipe configuration having annulus 44. As shown in the top, cross-sectional, and side views of FIG. 1C, spacer 38 may comprise screwed-together segments of high density polyethylene (HDPE). Centralizer 28 may also be provided to center the upper end of SCR 12 in upper funnel 17.

Figure 1D:
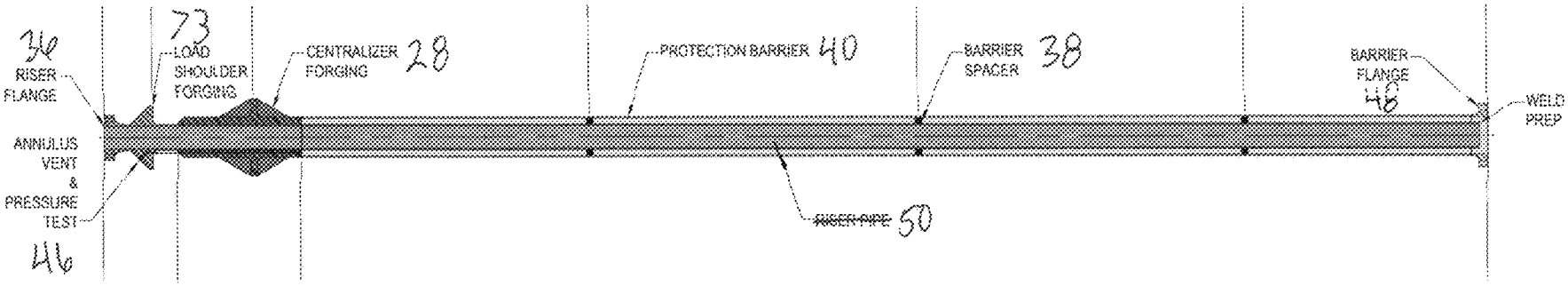
FIG. 1D is a cross-sectional view of an alternative embodiment of the pipe-in-pipe upper SCR tension segment shown in FIG. 1A.

The novel SCR upper section illustrated in FIG. 1A may be too long for certain types of shipping. An alternative embodiment is illustrated in FIG. 1D which includes barrier flange 48 on a lower end thereof for connection to one or more additional segments. Also shown in FIG. 1D is annulus vent and pressure test fitting 46 which provides fluid communication with the annulus for monitoring the pressure and/or composition of fluids within the annulus. Fitting 46 may similarly be provided on the SCR embodiment illustrated in FIG. 1D.

Figure 2A:
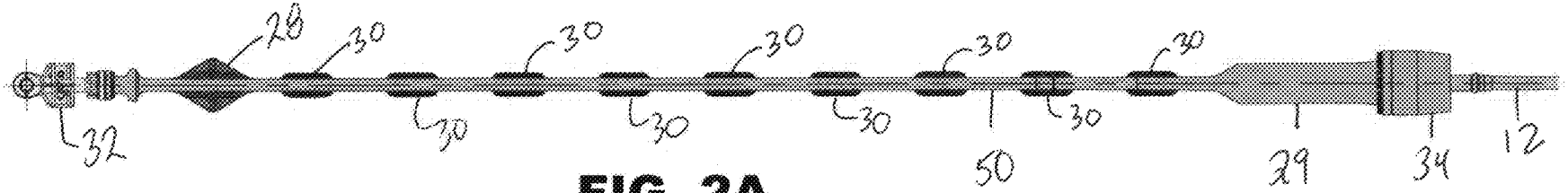
FIG. 2A is a cross-sectional view of the upper end of an SCR having a segmented upper protection system.
Figure 2B:
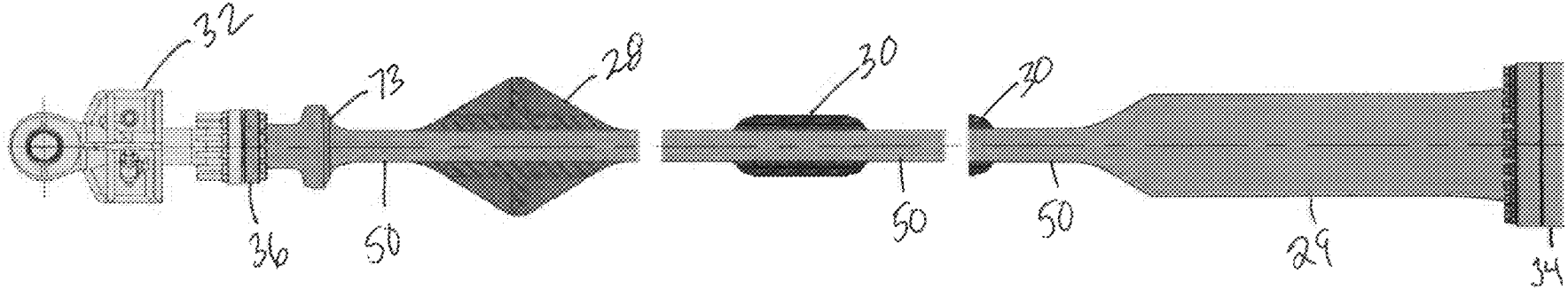
FIG. 2B is an enlarged view of the upper end of the SCR having a segmented upper protection system shown in FIG. 2A.

FIGS. 2A and 2B show an alternative embodiment of an SCR according to the invention having a plurality of spaced-apart bumpers 30 on a portion of riser tension section 50 in lieu of the pipe-in-pipe configuration of the embodiment illustrated in FIG. 1A. Bumpers 30 provide mechanical protection of riser tension section 50 during a pull-in operation. The SCR embodiment illustrated in FIGS. 2A and 2B may be particularly suitable for water-injection risers and the like which may require a lesser degree of thermal and mechanical protection.

Figure 3:
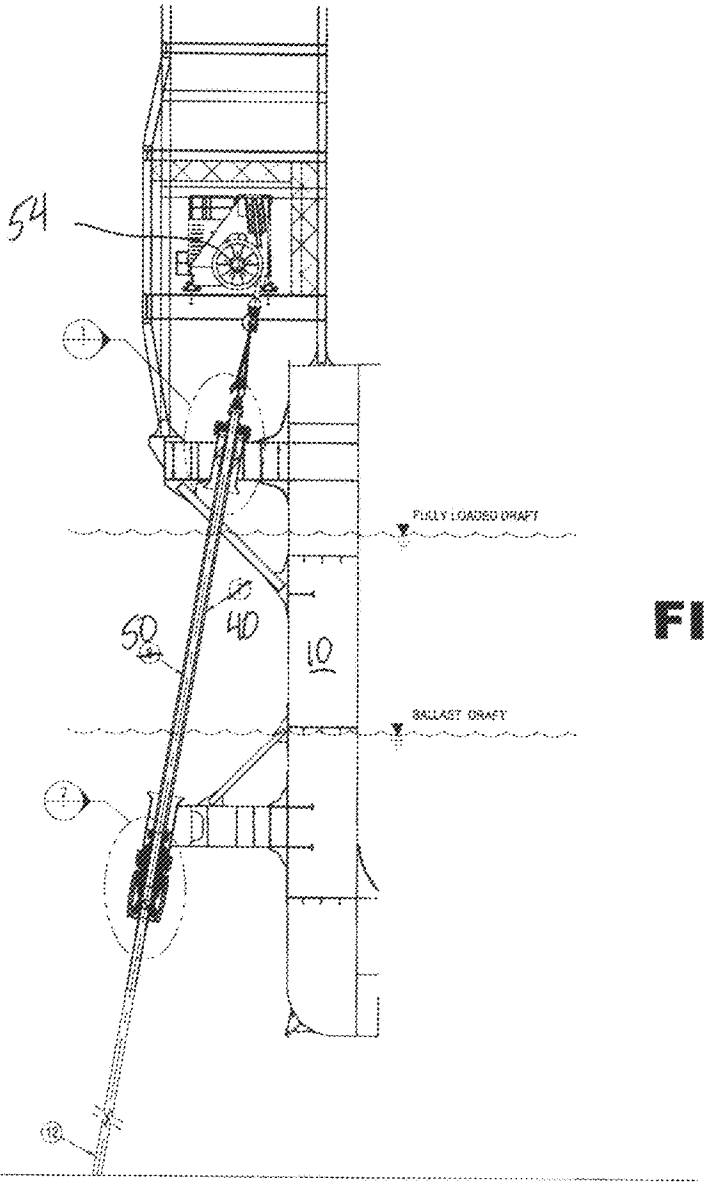
FIG. 3 is a side view, partially in cross section, of an SCR equipped with the pipe-in-pipe upper section illustrated in FIG. 1A and a flex joint installed in upper and lower funnels mounted to the side of an offshore floating vessel.
Figure 3A:
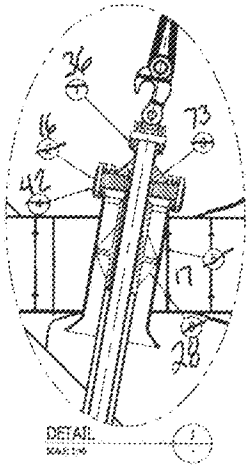
FIG. 3A is an enlarged, cross-sectional view of the SCR upper section in the upper funnel shown in FIG. 3.
Figure 3B:
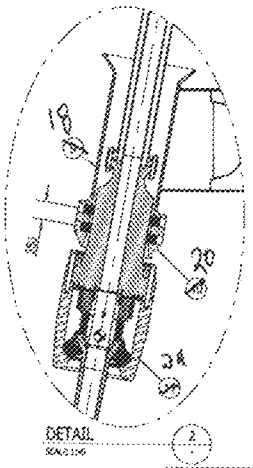
FIG. 3B is an enlarged, cross-sectional view of the SCR upper section in the lower funnel shown in FIG. 3.

FIG. 3 and the enlarged portions shown in FIGS. 3A and 3B illustrate the installation of an SCR as shown in FIG. 1A on a floating vessel having hull 10. It will be noted that upper funnel 17 and lower funnel 18 are axially aligned on an axis inclined from the vertical to accommodate the hang-off angle of SCR 12. Typically, the hang-off angle is between about 8 and about 12 degrees from the vertical. Winch 54 is positioned above upper funnel 17 such that the winch line is taken up on the winch drum in line with the common axis of upper funnel 17 and lower funnel 18. Stated another way, the outer surface of the winch drum may be tangential to the longitudinal axis of SCR 12 (and funnels 17 and 18). In the embodiment shown in FIG. 3, SCR 12 is equipped with elastomeric flex joint 34. Lateral and bending load interface 20 reacts side loads on SCR 12 to lower funnel 18. As shown in FIG. 3A, the apparatus may include split flange 16 for reacting tension loads on SCR 12 to upper funnel 17. Also shown are riser hang-off attachment flange 73, top flange 36 (with an attached pull head), and centralizer 28.

Figures 4, 4A, 4B:
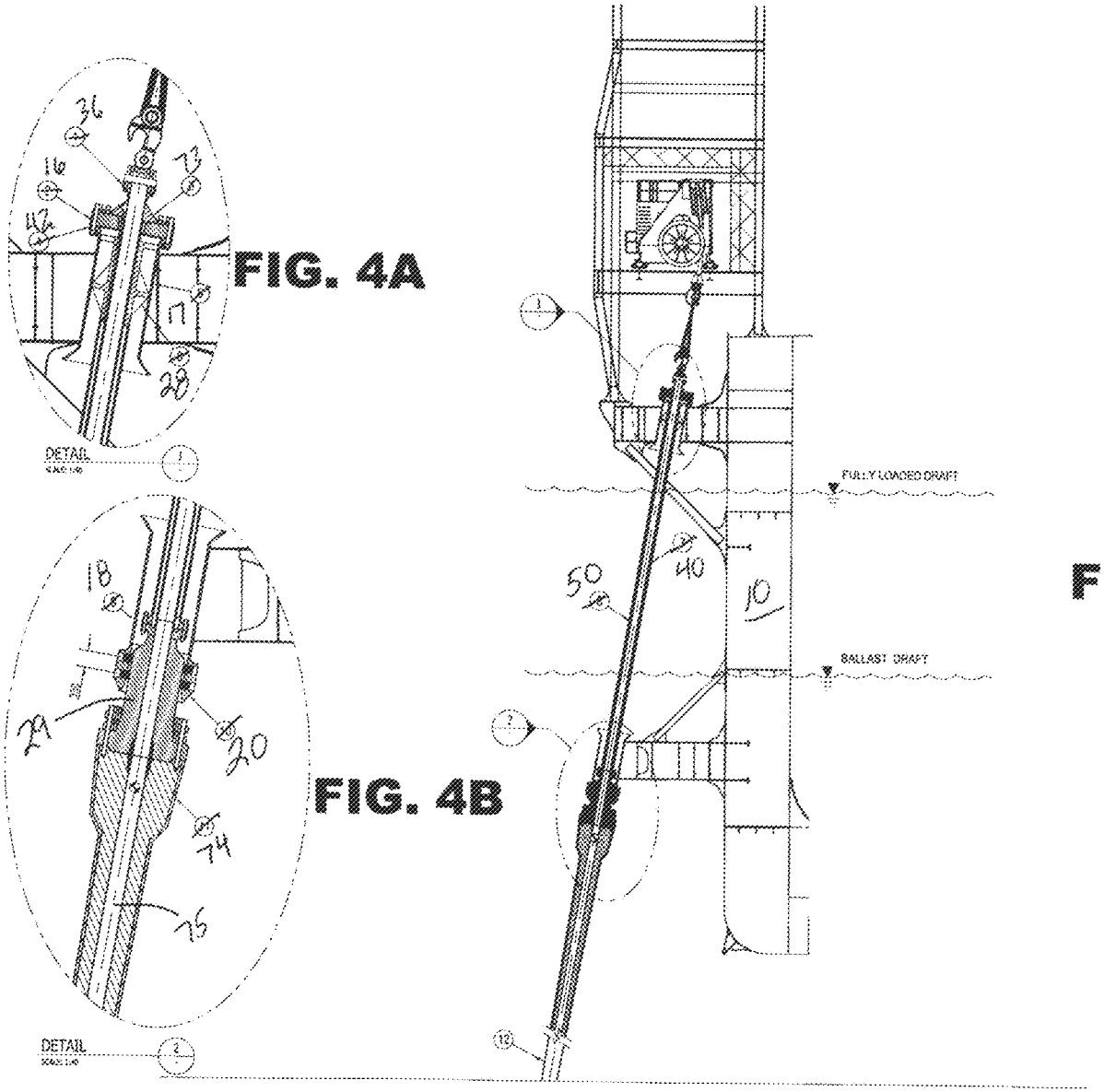
FIG. 4 is a side view, partially in cross section, of an SCR equipped with the pipe-in-pipe upper section illustrated in FIG. 1A and a tapered stress joint installed in upper and lower funnels mounted to the side of an offshore floating vessel.
FIG. 4A is an enlarged, cross-sectional view of the SCR upper section in the upper funnel shown in FIG. 4.
FIG. 4B is an enlarged, cross-sectional view of the SCR upper section in the lower funnel shown in FIG. 4.

FIG. 4 illustrates an embodiment having a tapered stress joint 74 in place of flex joint 34 on SCR 12.

Figure 5:
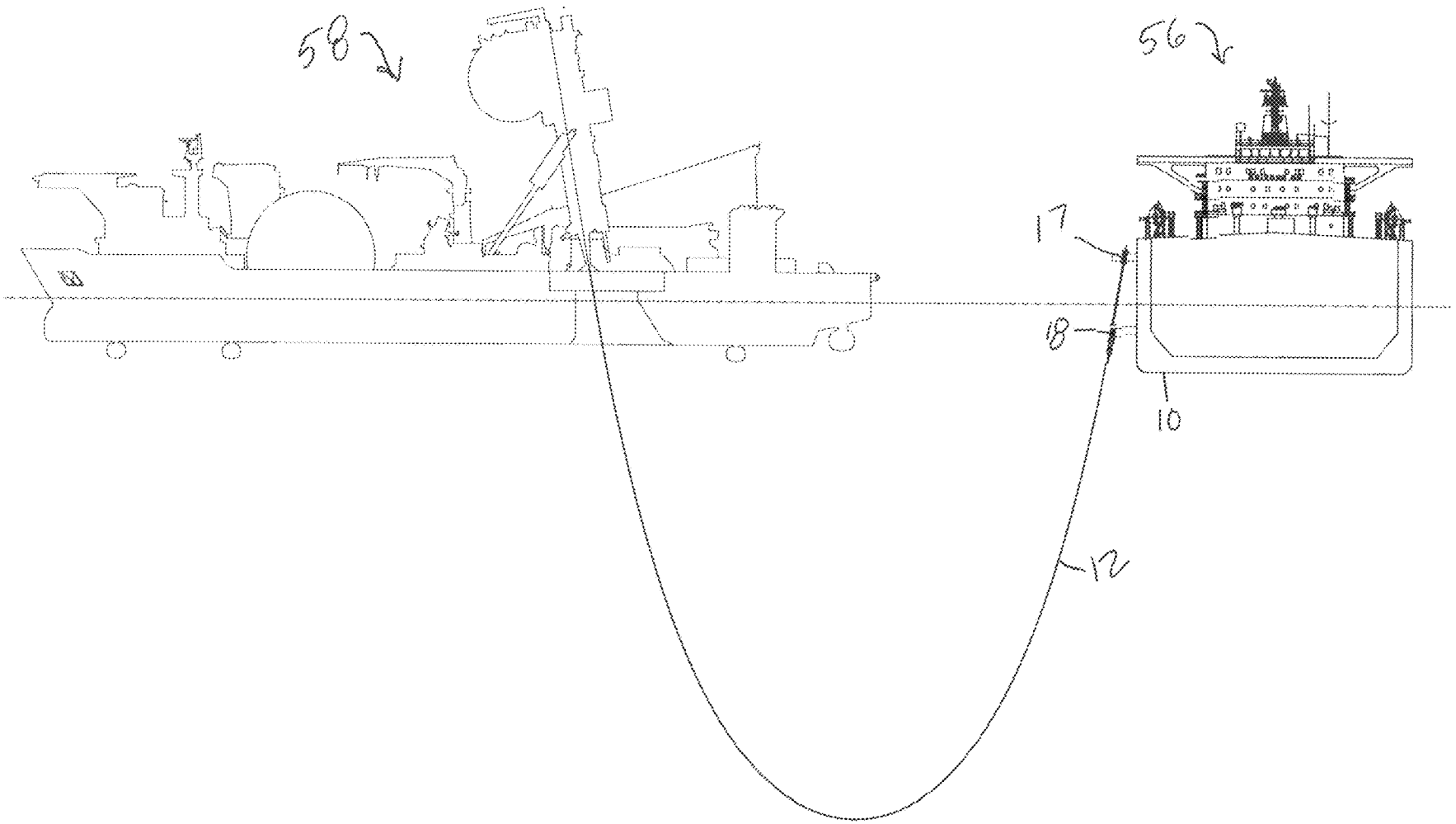
FIG. 5 illustrates the installation on an offshore floating vessel of an SCR hanging in a catenary from an SCR installation vessel.

FIG. 5 shows connecting SCR 12 from support vessel 58 to funnels 17 and 18 on FPSO 56. Alternatively, SCR 12 may be pre-installed on the seafloor and picked up through funnels 17 and 18.

Figure 6:
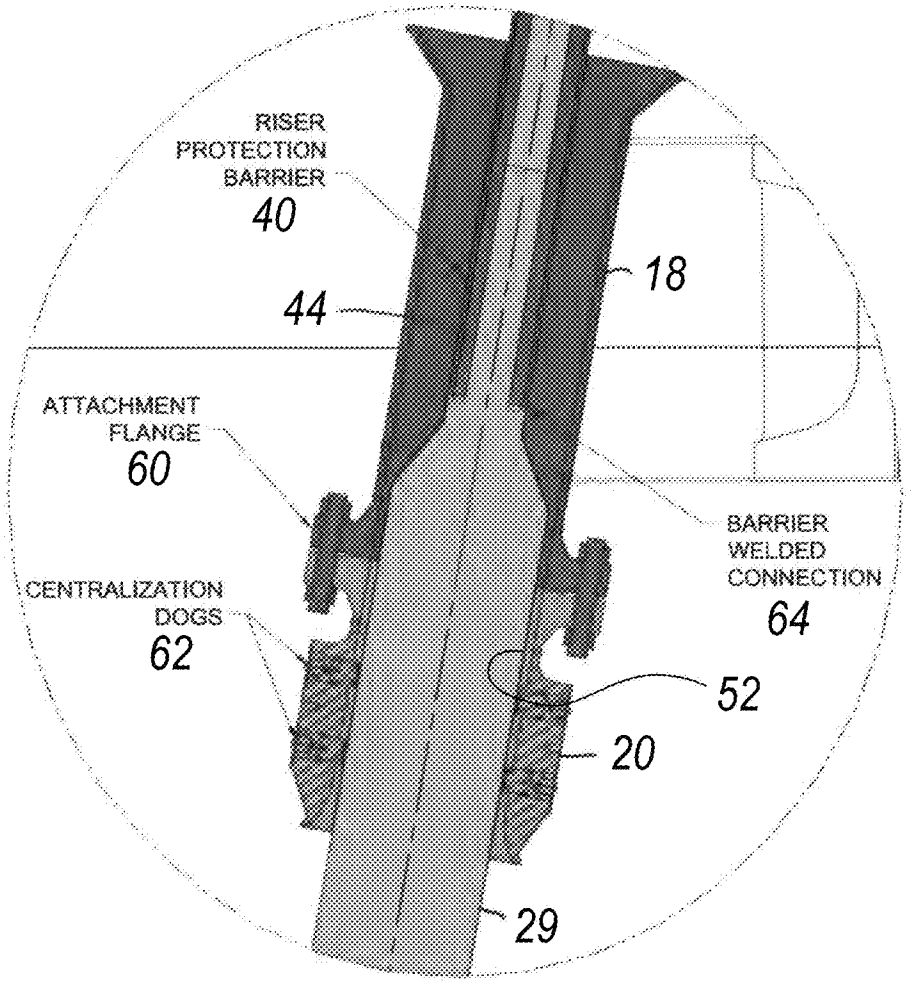
FIG. 6 is an enlarged, cross-sectional view of the SCR illustrated in FIG. 1A secured in a lower funnel equipped with a bolt-on lateral load transfer device.
Figures 7A, 7B, 7C:
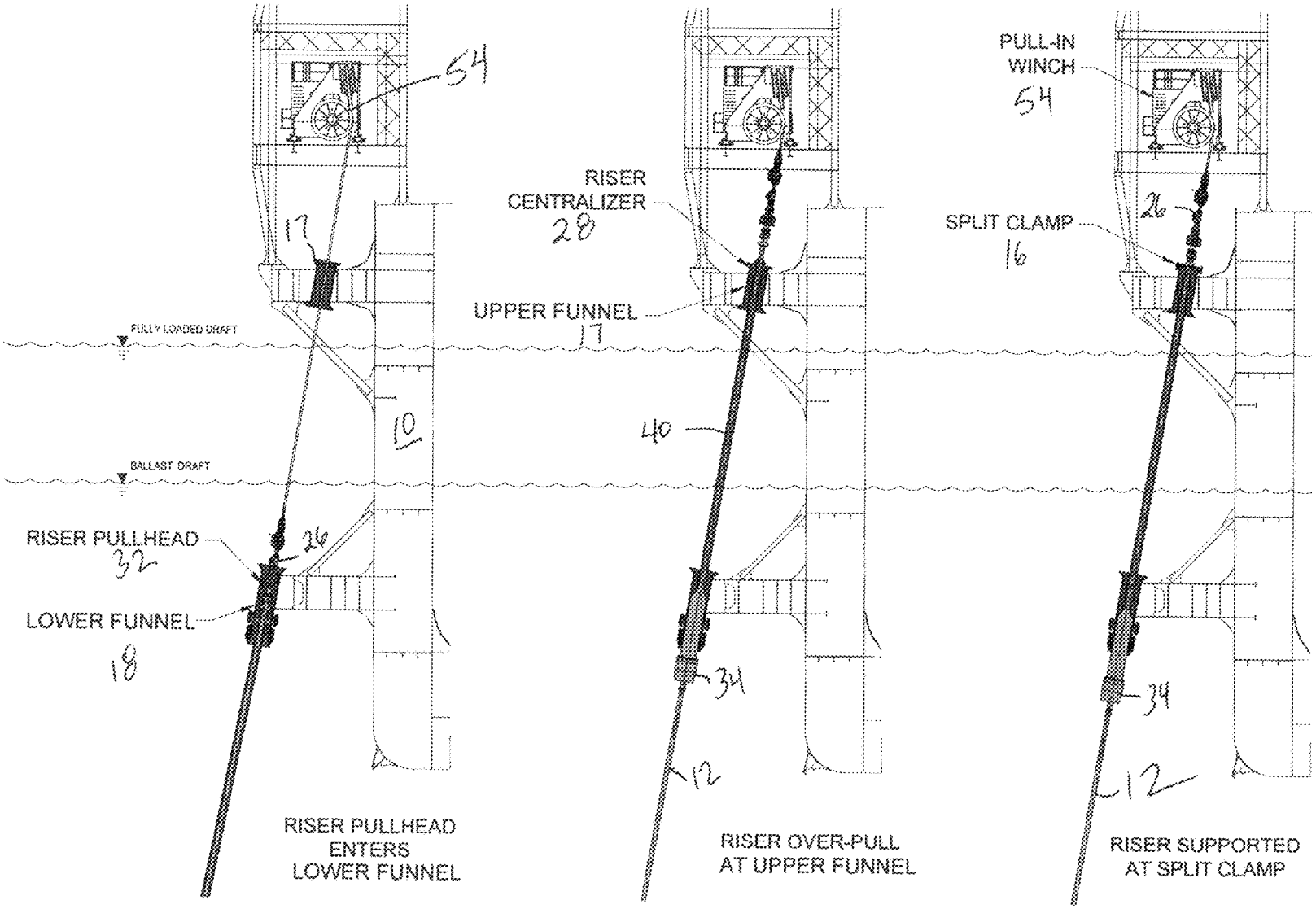
FIGS. 7A-7C illustrate sequentially the installation of an SCR according to the embodiment of FIG. 1A in upper and lower funnels attached to an offshore floating vessel.
Figures 8A, 8B, 8C:
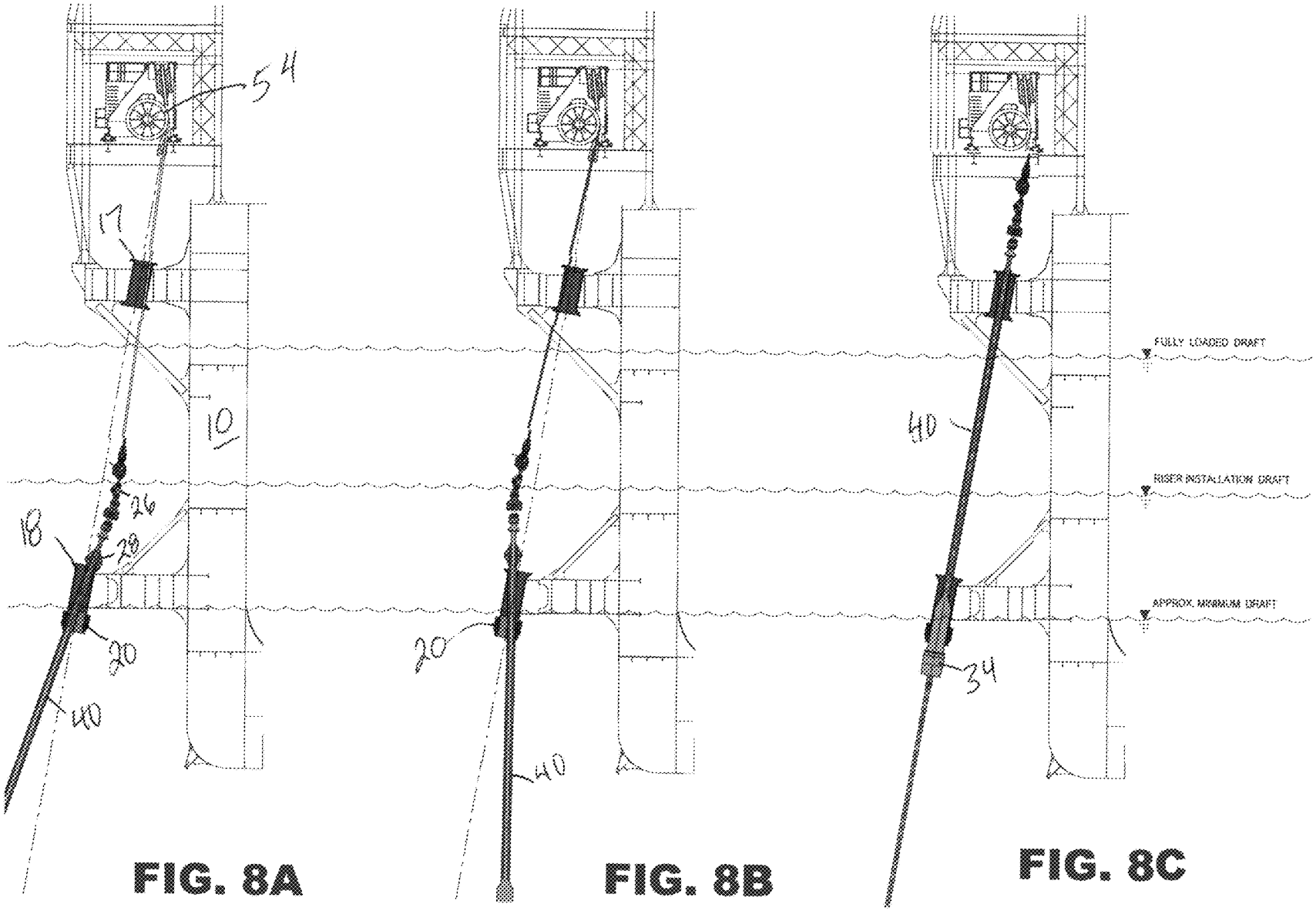
FIGS. 8A and 8B illustrate how the pipe-in-pipe configuration of the SCR illustrated in FIG. 1A protects the SCR during the installation process when the axis of the SCR is not aligned with that of the upper and lower funnels.
FIG. 8C illustrates the fully installed configuration of the SCR shown in FIGS. 8A and 8B.
Figure 9B:
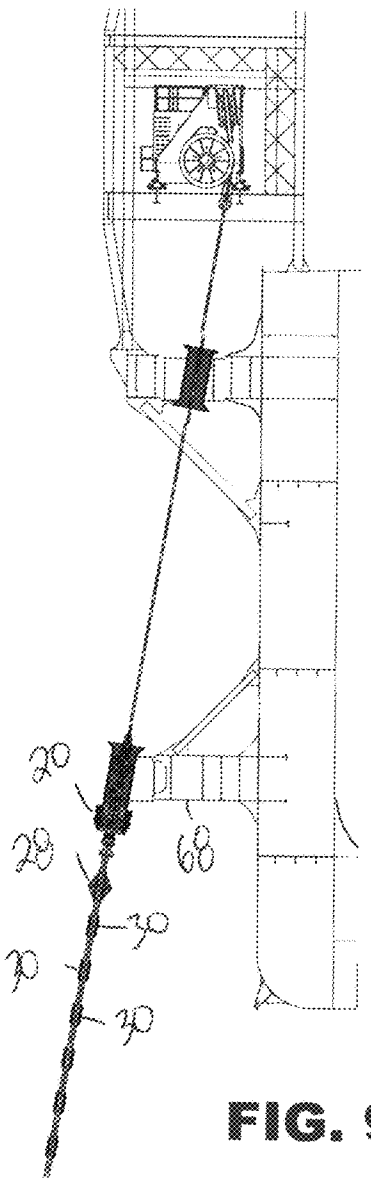
FIGS. 9A-9F illustrate sequentially the installation of an SCR according to the embodiment of FIG. 2A in upper and lower funnels attached to an offshore floating vessel
Figure 9A:
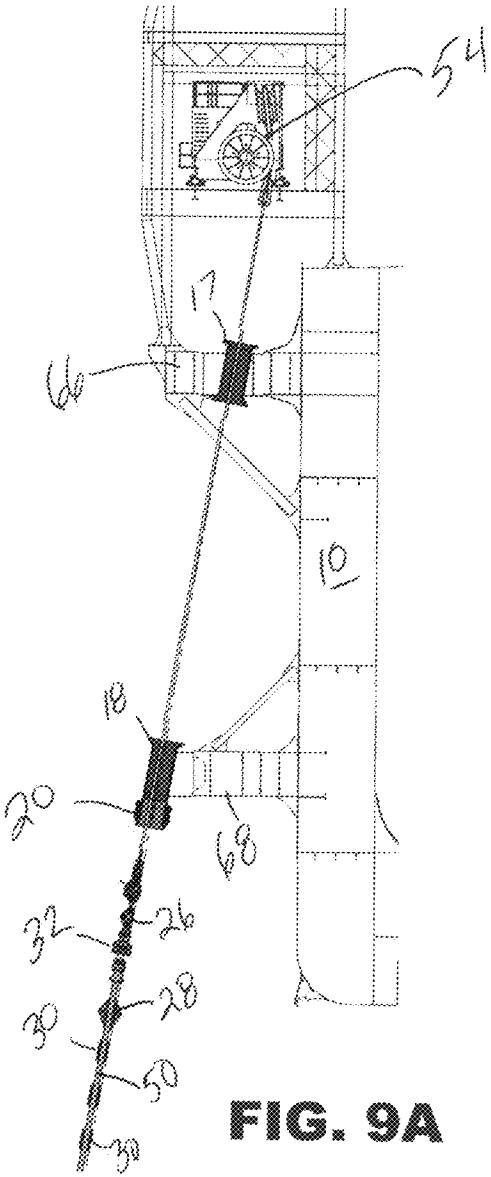
Figure 9D:
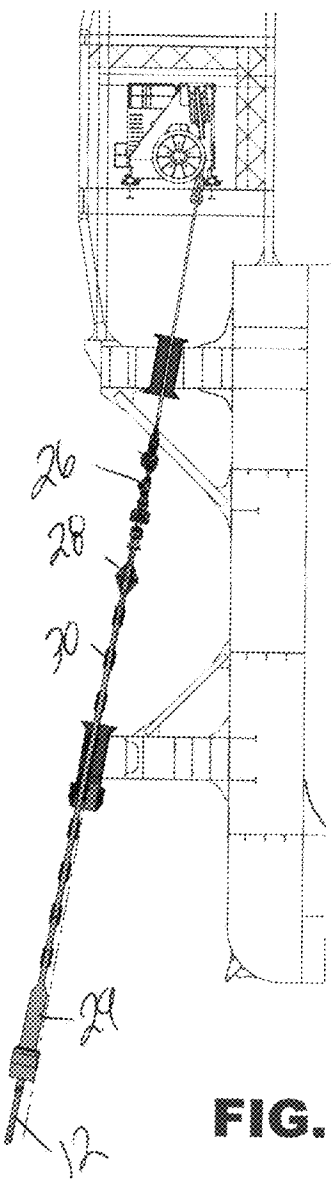
Figure 9C:
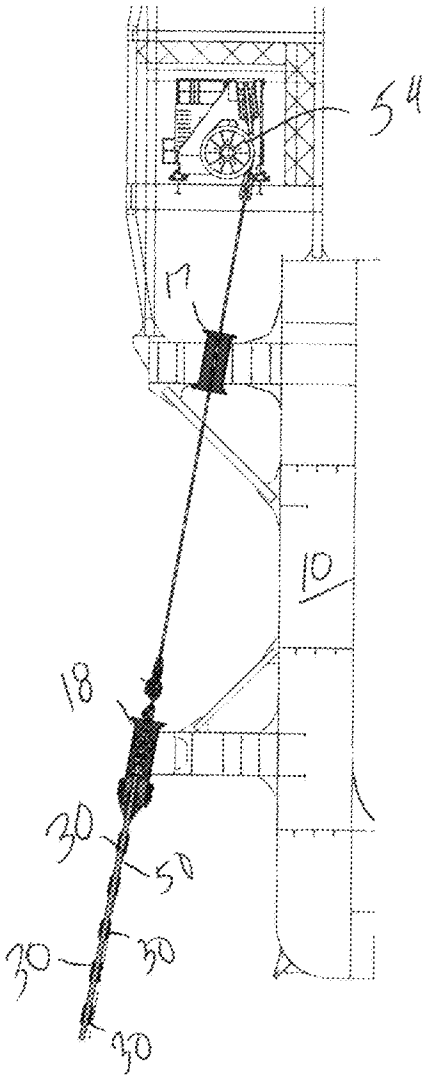
Figure 9F:
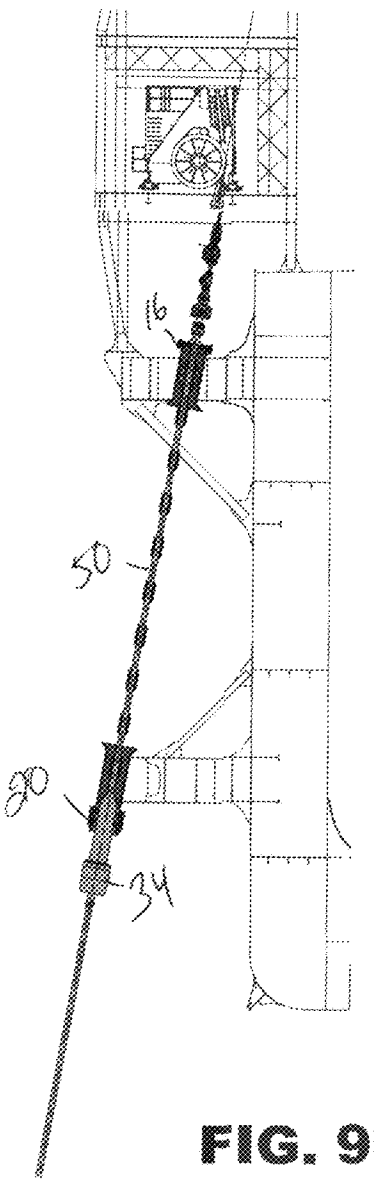
Figure 9E:
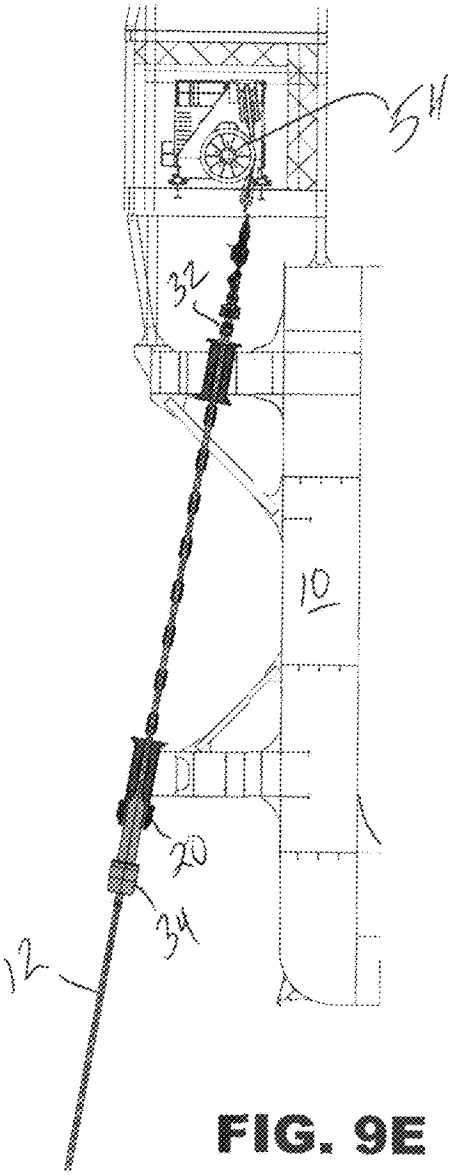
Figures 10A, 10B, 10C:
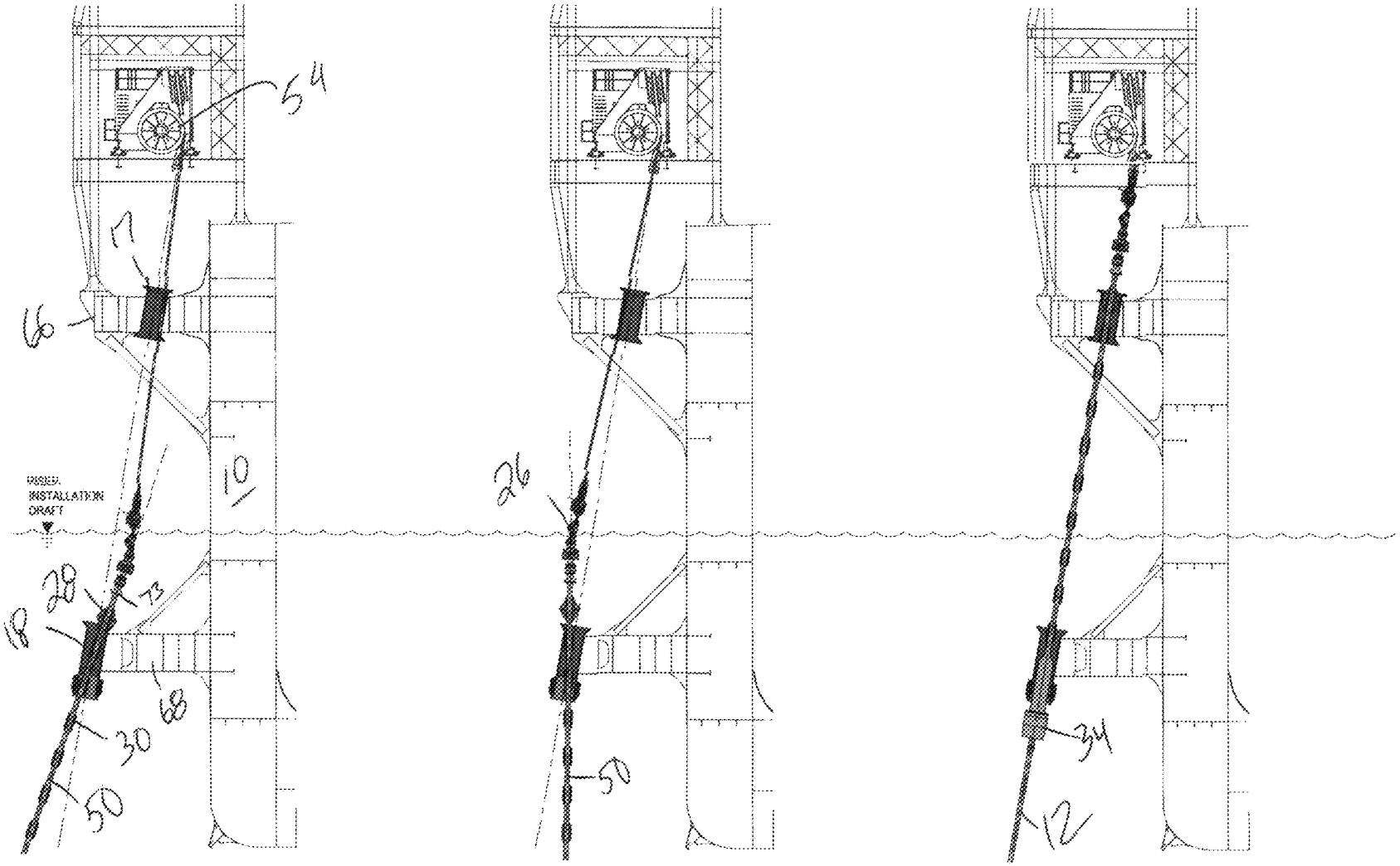
FIG. 10A and FIG. 10B illustrate how the bumpers of the SCR illustrated in FIG. 2A protects the SCR during the installation process when the axis of the SCR is not aligned with that of the upper and lower funnels.
FIG. 10C illustrates the configuration of the SCR shown in FIGS. 10A and 10B with clearance provided for installation of a split flange to support the SCR.

FIG. 6 shows a lower funnel 18 equipped with a bolt-on lateral and bending load interface 20 equipped with centralization dogs 62 (which may be hydraulically or mechanically actuated). When engaged, centralization dogs 62 react lateral and bending loads on the SCR from enlarged portion 52 to lower funnel 18.

Figure 11:
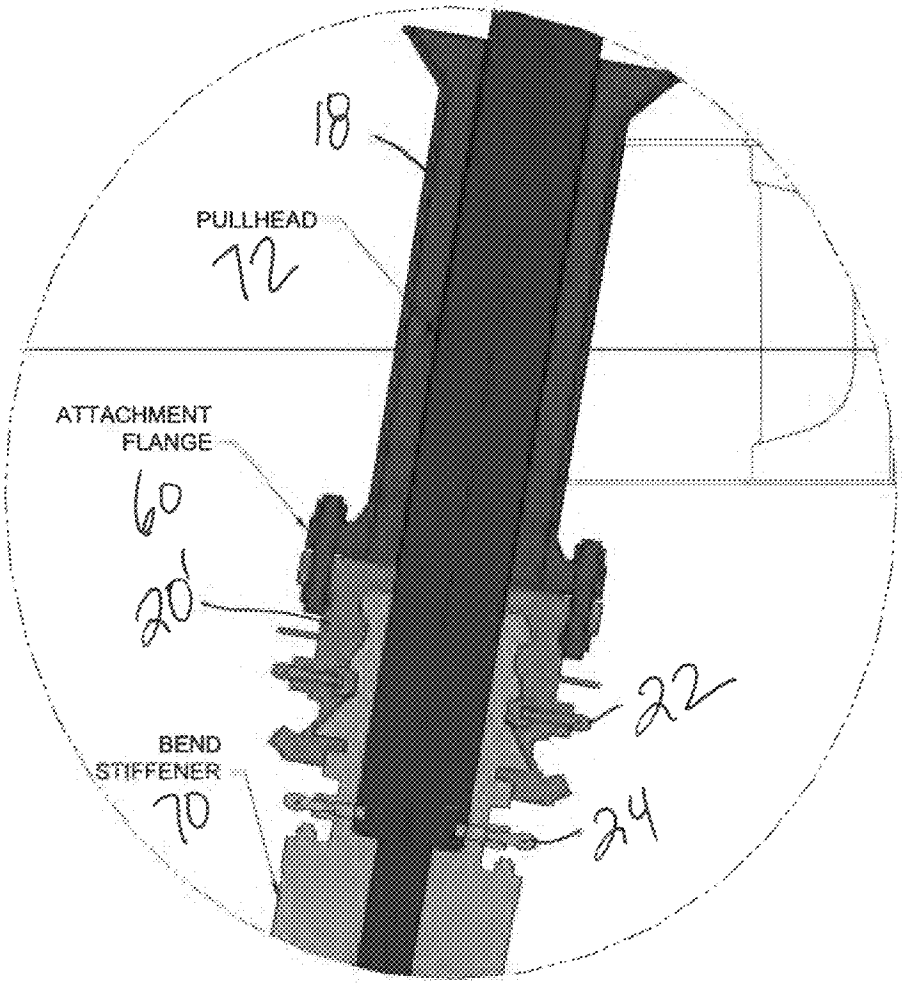
FIG. 11 is an enlarged view of a flexible riser equipped with a bend stiffener secured to the lower funnel.
Figures 12A, 12B, 12C:
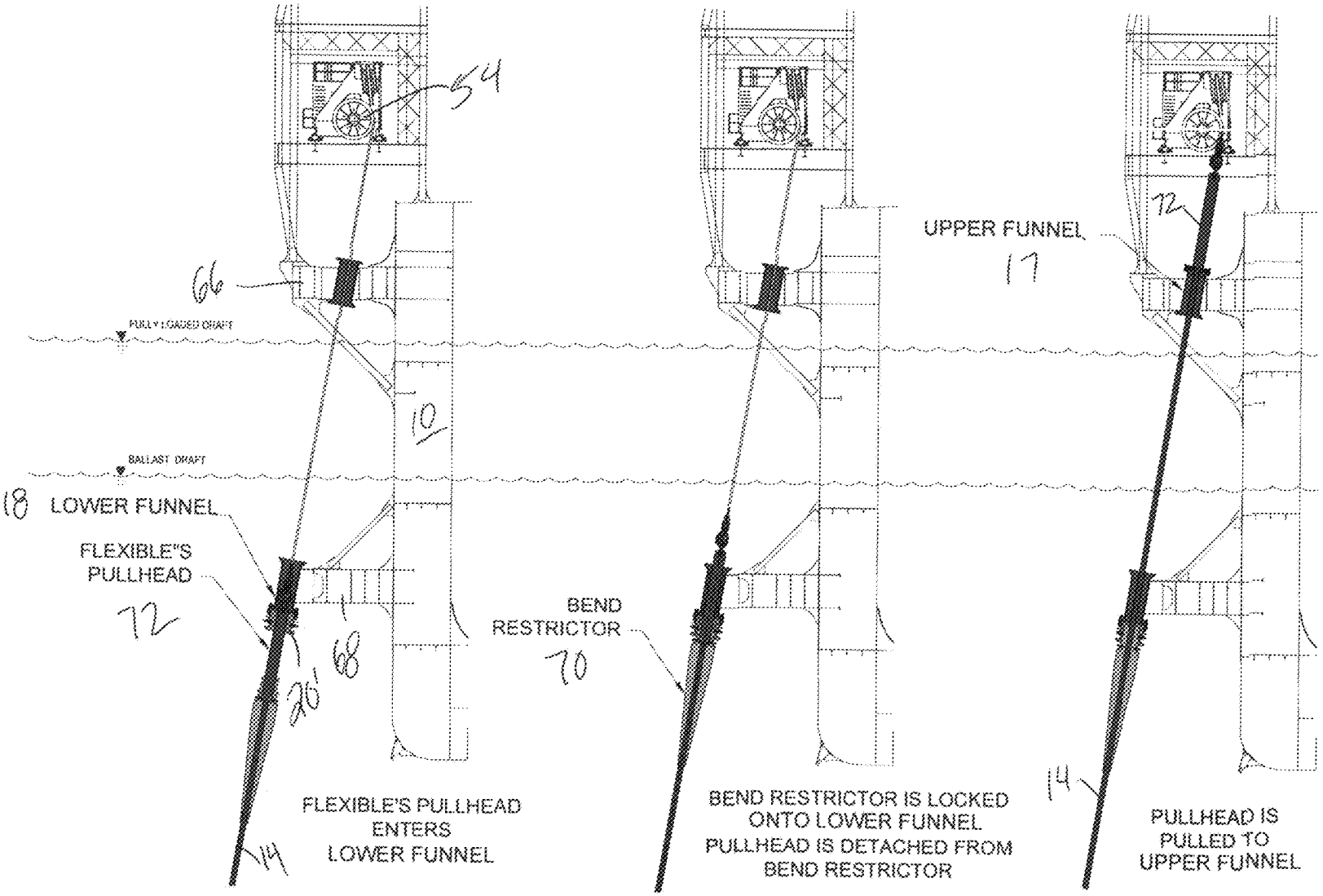
FIGS. 12A-12C illustrate sequentially the installation of a flexible riser in the embodiment shown in FIG. 11.

FIG. 11 shows a bolt-on interface 20' connected to attachment flange 60 of lower funnel 18. Interface 20' is configured for a flexible riser and includes bend stiffener locking latch 22 and pull head release latch 24. When pull head release latch 24 is disengaged, pull head 72 may be pulled through bend stiffener 70 to upper funnel 17 as illustrated sequentially in FIGS. 12A-12C.

Practice of the invention provides the following benefits:

Dry make up for top-of-riser testing and plumbing connections.

Large separation of funnels (guide funnels) reduces pull-in forces.

Provides the flexibility to adapt from an SCR hang-off receptacle to a flexible riser support.

Guide provided by outer pipe or segmented guides enables pull in between split funnels.

Reduces diver intervention for significant cost savings.

The time to complete a pull-in operation may also be reduced, lowering the cost of the installation spread. It is estimated that between one and three days may be saved per riser.

A single, long funnel may trap gas in the event of a leak thereby creating a potential explosion hazard. This is not possible with the separate, short funnels employed in the practice of the present invention. Although a single, long tube might make pull-in simpler, it would also add significant weight.

The flex joint (34) may be positioned beneath the water surface to maintain cooling of the flex element and allow cathodic protection.

Riser lateral and bending moments are transferred to the lower funnel, minimizing movement at the upper end of the riser top joint.

The riser top interface is always above water, so diver connections are not required. Test plug and end connection removal are simplified inasmuch as flooding of the riser is no longer a concern.

The twin funnel design reduces weight and cost of the interface in comparison to a single, long funnel or I-tube.

The lower connection may be either diver made up or ROV made up. Total required diver intervention is greatly reduced over previous systems.

A flanged or welded interface may be used for the lower connector. Using a flanged interface permits future adaption to a flexible riser, if required.

The upper riser joint may be pipe-in-pipe construction, providing additional accidental damage protection and thermal insulation to the risers. Alternatively, a single pipe with guide bumpers may be used.

Connection time may be reduced by several days, compared to the systems of the prior art.

Operating expenses are reduced because flange connections are accessible above the water surface.

Riser loads are spread over the hull (10) of the floating vessel.

A work platform may be provided around the top of the upper funnel.

A standardized interface may be provided at the bottom of the lower funnel (18) to accommodate different types of risers.

In an embodiment, an offshore, floating vessel having a nominal, fully loaded waterline comprises a first, upper funnel 17 mounted to and extending outboard from a side of the vessel on an upper porch 66 above the waterline of the vessel, a second, lower funnel 18 mounted to a lower porch 68 and extending outboard from the side of the vessel in spaced-apart, co-axial relation to the first funnel 17 at a location below the waterline of the vessel, wherein the first, upper funnel 17 is configured to support the upper end of a subsea riser 12, and the second, lower funnel 18 comprises means for reacting lateral and bending loads on the subsea riser supported in the upper funnel 17.

The offshore, floating vessel may further comprise a winch 54 positioned above the first, upper funnel 17 and having a winch line wound on a winch drum configured to wind the winch line co-axially with the upper and lower funnels.

The offshore, floating vessel may further comprise a split flange 16 configured to transfer tension loads on the subsea riser to the upper funnel 17.

In an embodiment, the second, lower funnel 18 is mounted farther outboard from the side of the vessel than the first, upper funnel 17.

In an embodiment, the upper funnel 17 and the lower funnel 18 have a longitudinal axis that is inclined from the vertical between about 8 to about 12 degrees.

In an embodiment, the means for reacting lateral and bending loads on a riser comprises a centralizer 20 attached to a lower end of the lower funnel 18. The centralizer may comprise retractable dogs 62 configured to bear against an outside surface of a subsea riser that passes through the lower funnel 18. The retractable dogs may be mechanically or hydraulically actuated.

The offshore, floating vessel may be a spread-moored FPSO vessel, a semi-submersible vessel, a spar-type vessel, a tension leg platform (TLP), or any similar such vessel having a hull 10.

In certain embodiments, the subsea riser is a steel catenary riser (SCR) 12 or a steel lazy wave riser (SLWR). The SCR may comprise a flex joint 34 below and proximate the lower funnel 18, or a tapered stress joint 74 below and proximate the lower funnel 18.

In yet other embodiments, the subsea riser is a flexible riser 14. The flexible riser may comprise a bend stiffener [bend restrictor] 70 below and proximate the lower funnel 18 and a pull head 72 configured to pull the riser 14 through the lower funnel 18 with the bend stiffener 70 attached to the lower funnel 18.

A steel catenary riser (SCR) 12 according to the invention may comprise a first flange 36 on a first, upper end of the SCR sized and configured to connect a pull head 32 to the SCR, a second, tension load-bearing flange 42 below and proximate the first flange, an outer pipe 40 surrounding an upper portion of the SCR below the tension load-bearing flange 42, and a plurality of spacers 38 holding the outer pipe 40 in spaced-apart relation to a central fluid conduit of the SCR and forming an annulus 44 between the outer pipe 40 and the central fluid conduit of the SCR.

Such an SCR may further comprise a radially enlarged portion 52 below and proximate a lower end of the portion surrounded by the outer pipe 40. The SCR may further comprise a flex joint 34 below and proximate the radially enlarged portion 52 or a tapered stress joint 74 below and proximate the radially enlarged portion.

A steel catenary riser (SCR) according to the invention may comprise a port 46 in the outer pipe 40 in fluid communication with the annulus 44 between the outer pipe 40 and the central fluid conduit of the SCR for connecting control line tubing for monitoring the pressure and/or content of fluid within the annulus.

In another embodiment, a steel catenary riser (SCR) 12 comprises a first flange 36 on a first, upper end of the SCR sized and configured to connect a pull head 32 to the SCR, a second, tension load-bearing flange 42 below and proximate the first flange, a radially enlarged portion below and spaced apart from the second flange 42, and a plurality of bumpers 30 on an outer wall of the SCR between the second flange and the radially enlarged portion 52.

A method of attaching a subsea riser (12 or 14) to an offshore floating vessel having a nominal, fully loaded waterline may comprise pulling an upper end of the riser through a first, upper funnel 17 mounted to and extending outboard from a side of the vessel at a location above the waterline of the vessel and a second, lower funnel 18 mounted to and extending outboard from the side of the vessel in spaced-apart, co-axial relation to the first funnel at a location below the waterline of the vessel, attaching the upper end of the subsea riser to the upper funnel 17 such that tension loads on the riser are reacted to the upper funnel 17, and attaching the riser to the second, lower funnel 18 such that lateral and bending loads on the riser are reacted to the lower funnel 18. Pulling the riser through the upper and lower funnels may be performed with a winch 54 positioned above the upper funnel 17 and having a winch line wound on a winch drum configured to wind the winch line co-axially with the upper and lower funnels. This may obviate the need for lateral steering winches and associated sheaves and minimize the pull-in load by reducing friction and side loads.

The foregoing presents particular embodiments of a system embodying the principles of the invention. Those skilled in the art will be able to devise alternatives and variations which, even if not explicitly disclosed herein, embody those principles and are thus within the scope of the invention.

Although particular embodiments of the present invention have been shown and described, they are not intended to limit what this patent covers. One skilled in the art will understand that various changes and modifications may be made without departing from the scope of the present invention as literally and equivalently covered by the following claims.

What is claimed is:

1. An offshore, floating vessel comprising:

a first, upper funnel mounted to and extending outboard from a side of the vessel at a location above a waterline of the vessel, a second, lower funnel mounted to and extending outboard from the side of the vessel in spaced-apart, co-axial relation to the first funnel at a location below the waterline of the vessel, wherein the first, upper funnel is configured to support the upper end of a subsea riser and to react tension loads on the subsea riser, wherein the first, upper funnel and the second, lower funnel have a longitudinal axis that is inclined from the vertical, wherein the second, lower funnel is mounted farther outboard from the side of the vessel than the first, upper funnel, and wherein the second, lower funnel comprises means for reacting lateral and bending loads on the subsea riser supported in the upper funnel.

2. The offshore, floating vessel recited in claim 1 further comprising:

a winch positioned above the first, upper funnel and having a winch line wound on a winch drum configured to wind the winch line co-axially with the first and second funnels.

3. The offshore, floating vessel recited in claim 1 further comprising:

a split flange configured to transfer tension loads on the subsea riser to the upper funnel.

4. The offshore, floating vessel recited in claim 1 wherein the longitudinal axis is inclined from the vertical between about 8 to about 12 degrees.

5. The offshore, floating vessel recited in claim 1 wherein the means for reacting lateral and bending loads on the subsea riser comprises a centralizer attached to a lower end of the lower funnel.

6. The offshore, floating vessel recited in claim 5 wherein the centralizer comprises retractable dogs configured to bear against an outside surface of the subsea riser that passes through the lower funnel.

7. The offshore, floating vessel recited in claim 6 wherein the retractable dogs are hydraulically actuated.

8. The offshore, floating vessel recited in claim 1 wherein the vessel is a spread-moored FPSO vessel.

9. The offshore, floating vessel recited in claim 1 wherein the vessel is a semi-submersible vessel.

10. The offshore, floating vessel recited in claim 1 wherein the vessel is a tension leg platform (TLP).

11. The offshore, floating vessel recited in claim 1 wherein the subsea riser is a steel catenary riser (SCR) or a steel lazy wave riser (SLWR).

12. The offshore, floating vessel recited in claim 11 wherein the steel catenary riser comprises a flex joint below and proximate the lower funnel.

13. The offshore, floating vessel recited in claim 11 wherein the steel catenary riser comprises a tapered stress joint below and proximate the lower funnel.

14. The offshore, floating vessel recited in claim 1 wherein the subsea riser is a flexible riser.

15. The offshore, floating vessel recited in claim 14 wherein the flexible riser comprises a bend stiffener below and proximate the lower funnel and a pull head configured to pull the subsea riser through the lower funnel with the bend stiffener attached to the lower funnel.

16. A method of attaching a subsea riser to an offshore floating vessel comprising:

pulling an upper end of the subsea riser through a first, upper funnel mounted to and extending outboard from a side of the vessel at a location above a waterline of the vessel and pulling a second, lower funnel mounted to and extending outboard from the side of the vessel in spaced-apart, co-axial relation to the first funnel at a location below the waterline of the vessel, wherein the first, upper funnel and the second, lower funnel have a longitudinal axis that is inclined from the vertical, and wherein the second, lower funnel is mounted farther outboard from the side of the vessel than the first, upper funnel;

attaching the upper end of the subsea riser to the upper funnel such that tension loads on the subsea riser are reacted to the upper funnel; and attaching the subsea riser to the second, lower funnel such that lateral and bending loads on the subsea riser are reacted to the second, lower funnel.

17. The method recited in claim 16 wherein pulling the subsea riser through the upper and lower funnels is performed with a winch positioned above the first, upper funnel and having a winch line wound on a winch drum configured to wind the winch line co-axially with the first and second funnels.

* * * * *